United States Patent [19]

Marchetti

[11] Patent Number: 4,738,075

[45] Date of Patent: Apr. 19, 1988

[54] AUTOMATIC TAPING UNIT WITH IMPROVED SYSTEM OF WITHDRAWAL OF THE TAPE APPLYING ROLLERS FOR CARTON SEALING MACHINES

[76] Inventor: Augusto Marchetti, Piazza Sicilia, 7 - 20146 Milano, Italy

[21] Appl. No.: 869,561

[22] Filed: Jun. 2, 1986

Related U.S. Application Data

[62] Division of Ser. No. 788,223, Oct. 16, 1985, Pat. No. 4,572,188.

[30] Foreign Application Priority Data

Oct. 17, 1984 [IT] Italy ..... 23192 A/84

[51] Int. Cl.[4] ..... B65B 51/06; B65C 1/04

[52] U.S. Cl. ..... 53/137; 493/117

[58] Field of Search ..... 53/137; 156/468, 475, 156/486, 492, 530; 493/117

[56] References Cited

U.S. PATENT DOCUMENTS

| | | | |
|---|---|---|---|
| 2,861,403 | 11/1958 | Weisman | 53/137 X |
| 2,873,039 | 2/1959 | Powel . | |
| 2,940,233 | 6/1960 | Bracey | 53/137 X |
| 3,466,843 | 9/1969 | Mumper | 53/137 |
| 3,491,657 | 1/1970 | Feigel | 53/137 X |
| 4,061,526 | 12/1977 | Warshaw | 53/137 X |
| 4,120,741 | 10/1978 | Linner | 53/137 X |

FOREIGN PATENT DOCUMENTS

| | | | |
|---|---|---|---|
| 2459757 | 2/1981 | France | 53/137 |

*Primary Examiner*—John Sipos

*Attorney, Agent, or Firm*—Cushman, Darby & Cushman

[57] ABSTRACT

An inlet applying roller and an outlet applying roller are elastically urged to project, at rest, from a casing which may be fixed to a sealing machine. The inlet applying roller is rotatably supported by support arms, which are movable along path defined by shaped windows engaged with a fixed pivot, and the outlet applying roller is rotatably supported by lever arms rotatable about a fixed fulcrum. Said support arms for the inlet and outlet rollers are kinematically connected to the support lever arms of the outlet roller so that the withdrawal movementof the inlet roller is accompanied by a simultaneous withdrawal movement of the outlet roller and the successive coming-out movement of the inlet roller is made dependent on a simultaneous coming-out movement of the outlet roller. A cutting blade is arranged between said rollers to cut the tape between subsequent cartons.

3 Claims, 11 Drawing Sheets

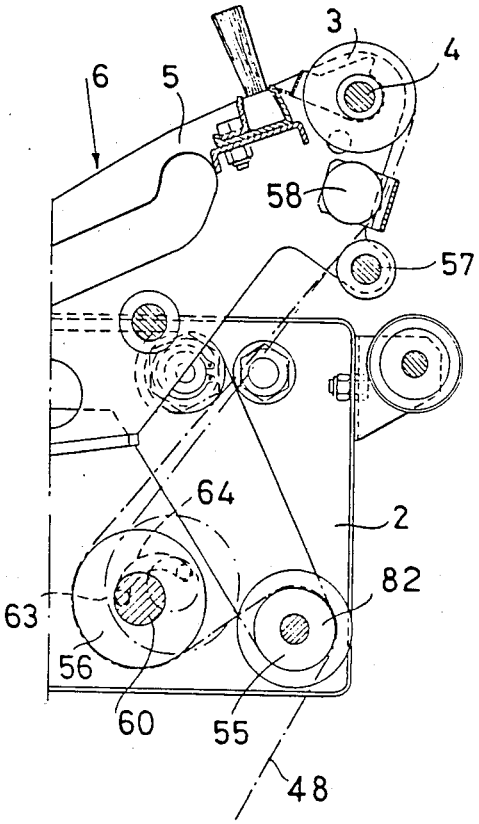
Fig. 6
Fig. 8
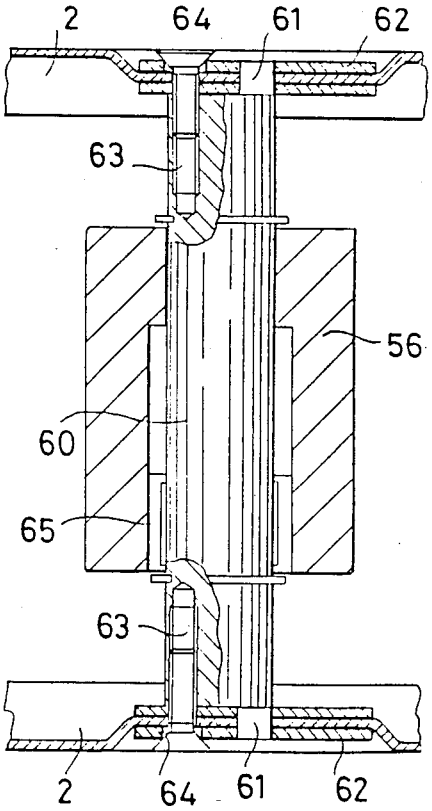
Fig. 7
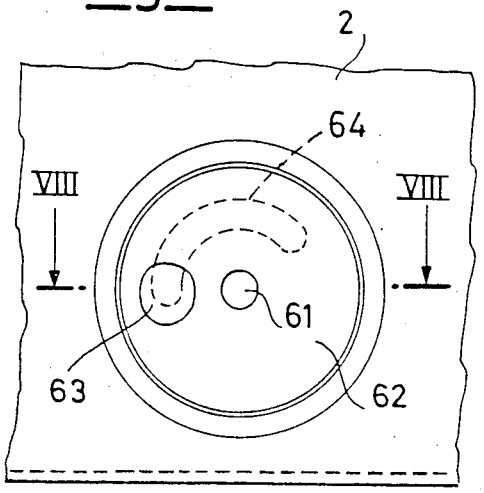

AUTOMATIC TAPING UNIT WITH IMPROVED SYSTEM OF WITHDRAWAL OF THE TAPE APPLYING ROLLERS FOR CARTON SEALING MACHINES

This is a division of application Ser. No. 788,223 filed Oct. 16, 1985, now U.S. Pat. No. 4,572,188.

The present invention relates to an automatic taping unit with improved system of withdrawal of the tape applying rollers for carton sealing machines.

There are known those sealing machines which apply adhesive sealing tapes along the top and the bottom of cartons, once the folding of their closing flaps has been operated.

To such end the above said machines employ automatic taping units arranged one below and the other above the advancement path of the cartons along a resting plane and suitably designed to allow the same carton to cause automatically the drawing, the cutting and the application of the correct length of tape.

Conventional taping units include two rubber-like applying rollers arranged one at the inlet and the other at the outlet of the taping unit and elastically urged to project from the outline of the casing of the taping unit and in the carton advancement path, but, on the other hand, capable of returning within the same outline during the passage of the cartons. A cutting blade is also arranged between the two said rollers with similar features of return and projection with respect to the casing of the taping unit.

The inlet roller has the function of causing an initial tape length to adhere to the front wall of the carton and then, once forced by the carton to return into the outline of the casing of the taping unit, of accompanying the following tape length, pulled by the carton, along the adiacent horizontal wall (top or bottom) of the carton and up to the rear wall of the latter. The outlet roller, once overcome by the carton and thus let project from the outline of the casing of the taping unit, has in its turn the function of causing a final tape length to adhere to the rear wall of the carton. The cutting blade, still after its overcoming by the advancing carton, has finally the function of carrying out the cutting of the tape between one carton and another, thereby fixing the length of said final tape length and that of the successive initial length for the following carton.

A problem of these taping units is connected to the withdrawal and coming out movement of the tape applying rollers, which movement should be such as to allow the perfect adhesion of the initial and final tape length to the front and rear walls of the carton and, at the same time, to avoid possible jamming and damages of the carton.

This having been considered, the object of the present invention is to realize an automatic taping unit for carton sealing machines, which includes withdrawal and coming-out mechanisms for the two taping applying rollers, which mechanisms allow to satisfy the above said requirements.

In view of such object the taping unit according to the invention, comprising a casing adapted to be fixed to a sealing machine along the carton advancement path, an inlet applying roller and an outlet applying roller elastically urged to project from said casing to be engaged and forced to return into said casing by the front of an advancing carton, an adhesive taping supply arranged to put, at rest, a free end of the tape in contact with said inlet roller in order to be engaged and adhesively drawn forward by the carton front and further realized in such a way as to allow subsequently said tape to follow the drawing of said free end and to slide on said inlet roller to extend adhesively along the adjacent horizontal wall of the carton, and a cutting blade arranged between said inlet and outlet rollers and provided with actuating means capable of causing it to return into the outline of said casing before being reached by the carton front and to project from said outline for cutting the tape between said inlet and outlet rollers after having been overcome by the rear wall of the carton and before said horizontal wall of the carton abandons said outlet roller, is mainly characterized in that said inlet applying roller is supported by a pair of movable support arms with withdrawal movement guided by shaped windows engaged with a fixed pivot, said windows having a lower end portion very inclined with respect to a horizontal plane, an extended intermediate portion less inclined with respect to a horizontal plane and finally an almost vertical upper end portion.

In this way, the inlet applying roller, after an initial withdrawal movement with high vertical component which allows it the correct application of an initial tape length to the front wall of the carton and a successive progressive withdrawal movement with greater horizontal component, completes its return movement with a substantially vertical displacement which allows it to pass over the separation corner between the front wall and the adjacent horizontal wall of the carton without giving rise to jamming problems with said corner and to consequent possible damages for the carton. In particular, a possible swelling of the carton bottom is left without effect.

Another feature included in the taping unit according to the invention is in its turn represented by the fact that said pair of support arms for the inlet applying roller is kinematically connected to a pair of support lever arms for the outlet applying roller, so that the withdrawal movement of the inlet applying roller under the thrust of the advancing carton and with the guide of said shaped windows is accompanied by a simultaneous withdrawal movement of the outlet applying roller through rotation of said pair of lever arms about a fixed fulcrum and the successive coming-out movement of the inlet applying roller for its return to the projected position is made dependent on a simultaneous coming-out movement of the outlet applying roller after its abandonment by said horizontal wall of the carton.

The position of the fixed fulcrum about which the rotation of the outlet applying roller occurs is moreover chosen in such a way as to give said outlet roller a coming-out rotation with predominant horizontal component, which allows the same roller to carry out the correct application of the final tape section to the rear wall of the carton, while following the advancement movement of the same carton.

Still according to the invention, it is further provided that the adhesive tape supply includes, upstream of the inlet applying roller, a succession of tape guiding and tensioning rollers, at least one of which is carried by movable support means associated to said blade actuating means in such a way as to cause tensioning of the adhesive tape when the cutting blade returns into the casing outline and to cause loosening of the tape tension when said actuating means control the subsequent coming out of the cutting blade for cutting the adhesive tape.

In this way, the tape is correctly tensioned at the cutting time, but the tension is loosened immediately after, thereby avoiding possible problems of repositioning of the tape end, as due to excessive tension of the tape once the cutting has been executed.

It may further be provided that said succession of guiding rollers includes, downstream of said guiding roller carried by movable support means, an unidirectional roller arranged in such a position as to be progressively approached by said inlet applying roller during its withdrawal movement.

This produces the important effect of loosening during such movement the tension of the adhesive tape between the inlet applying roller and said unidirectional guide roller, thereby avoiding the carton the necessity of winning, in addition to the initial resistance of the inlet roller, also that caused by the tensioning of the tape. Once the withdrawal of the inlet applying roller has been completed, on the other hand, the advancing carton may retrieve the eccess of adhesive tape which is downstream of the unidirectional guide roller and put again correctly in tension the same tape. The carton is thus less subjected to resistances and therefore to possible pointings and damages, particularly in the delicate step of passing over the inlet roller in the withdrawal movement.

It is finally very important that the free end of the adhesive tape is always positioned in the same point of the inlet applying roller so as to ensure identical initial tape length for all the cartons. On the other hand, the use of adhesive tapes of different elasticity may produce different lengthenings of the tape when in working tension for its application to the carton and such different lengthenings may produce, with tension loosened again, different locations of the free end of the tape on the inlet applying roller.

In order to solve the problem in satisfactory manner, according to the invention it is provided that said unidirectional guide roller is rotatably mounted on a support pivot, which is in its turn provided with an eccentric pivot and means are provided to change the angular position of said support pivot and of the respective guide roller with respect to said eccetric pivot.

In this way, the distance, at rest, between said guide roller and the inlet applying roller may be changed so as to take into account and to compensate the different lengthening capacities of the several types of tape which may be used.

The features of the present invention will be made more apparent by the following detailed description of an embodiment thereof, which is shown by way of non-limiting example in the enclosed drawings, in which:

FIG. 6 shows the detail of an initial adjustment of the adhesive tape supply, which is to be executed according to the intrinsic features of the used tape;

FIG. 7 shows an enlarged view from outside of the device which allows said adjustment;

FIG. 8 shows said device in section along line VIII—VIII of FIG. 7;

Figure 1:
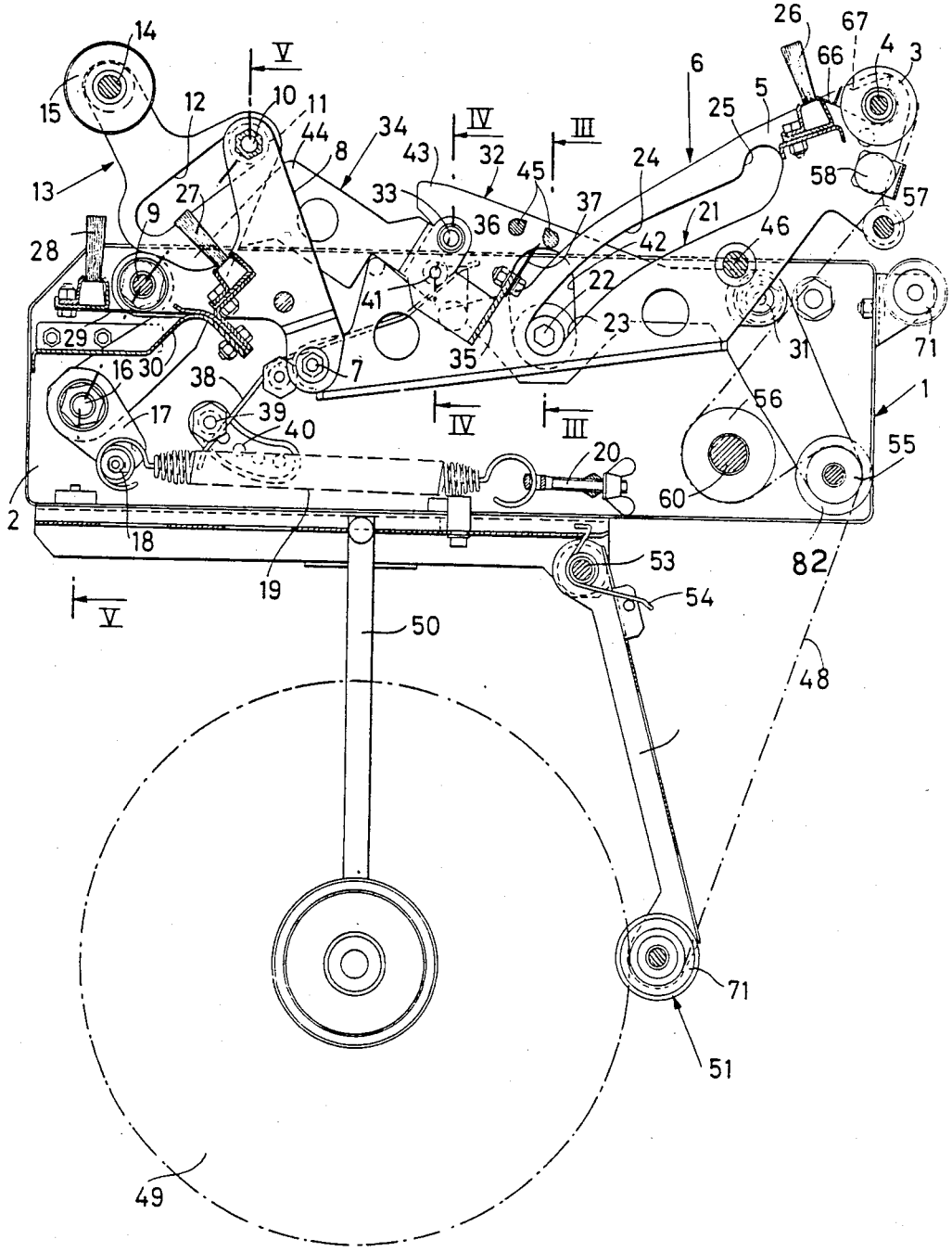
FIG. 1 shows in longitudinal section a taping unit according to the invention, arranged for the sealing of the carton bottom.
Figure 2:
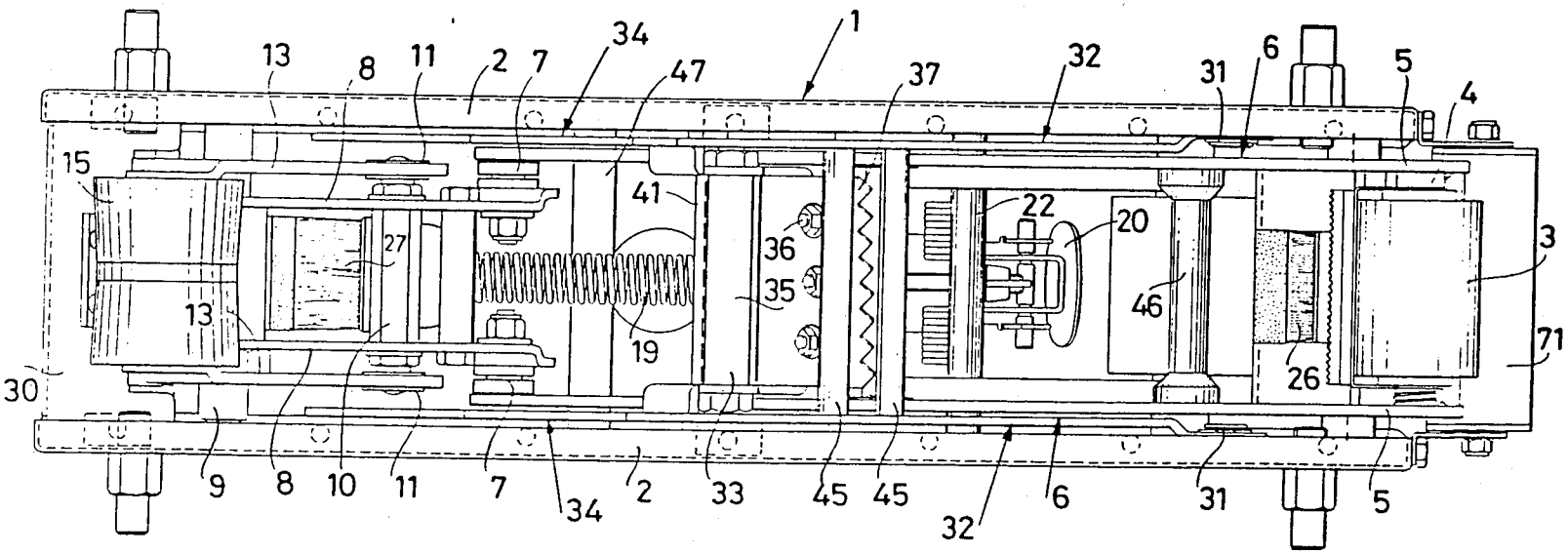
FIG. 2 shows said taping unit in top plan.
Figure 3:
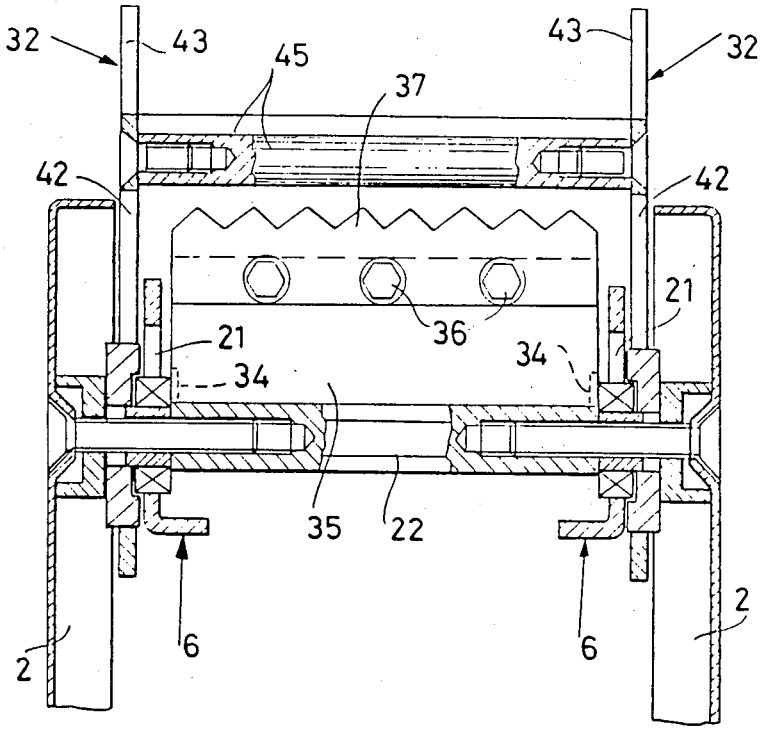
FIG. 3 shows an enlarged detail of said taping unit in cross section along line III—III of FIG. 1.
Figure 4:
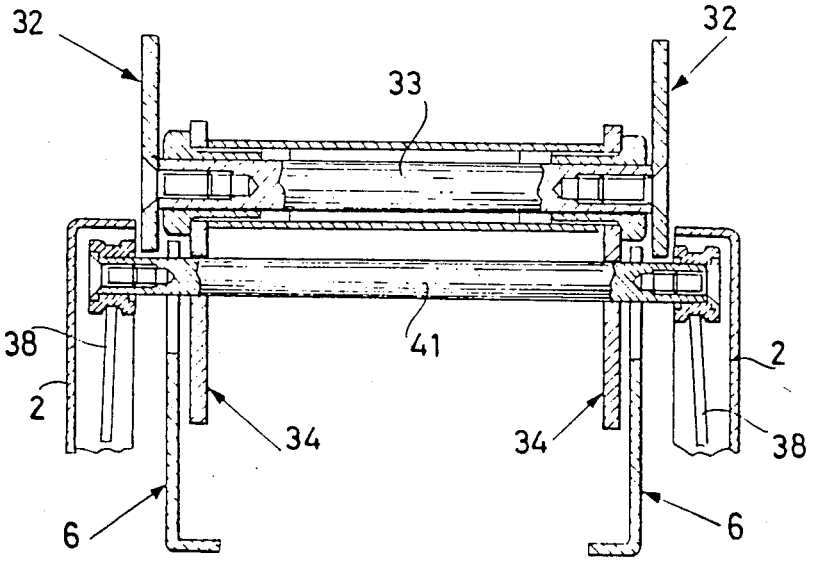
FIG. 4 shows another enlarged detail of said taping unit, in cross-section along line IV—IV of FIG. 1.
Figure 5:
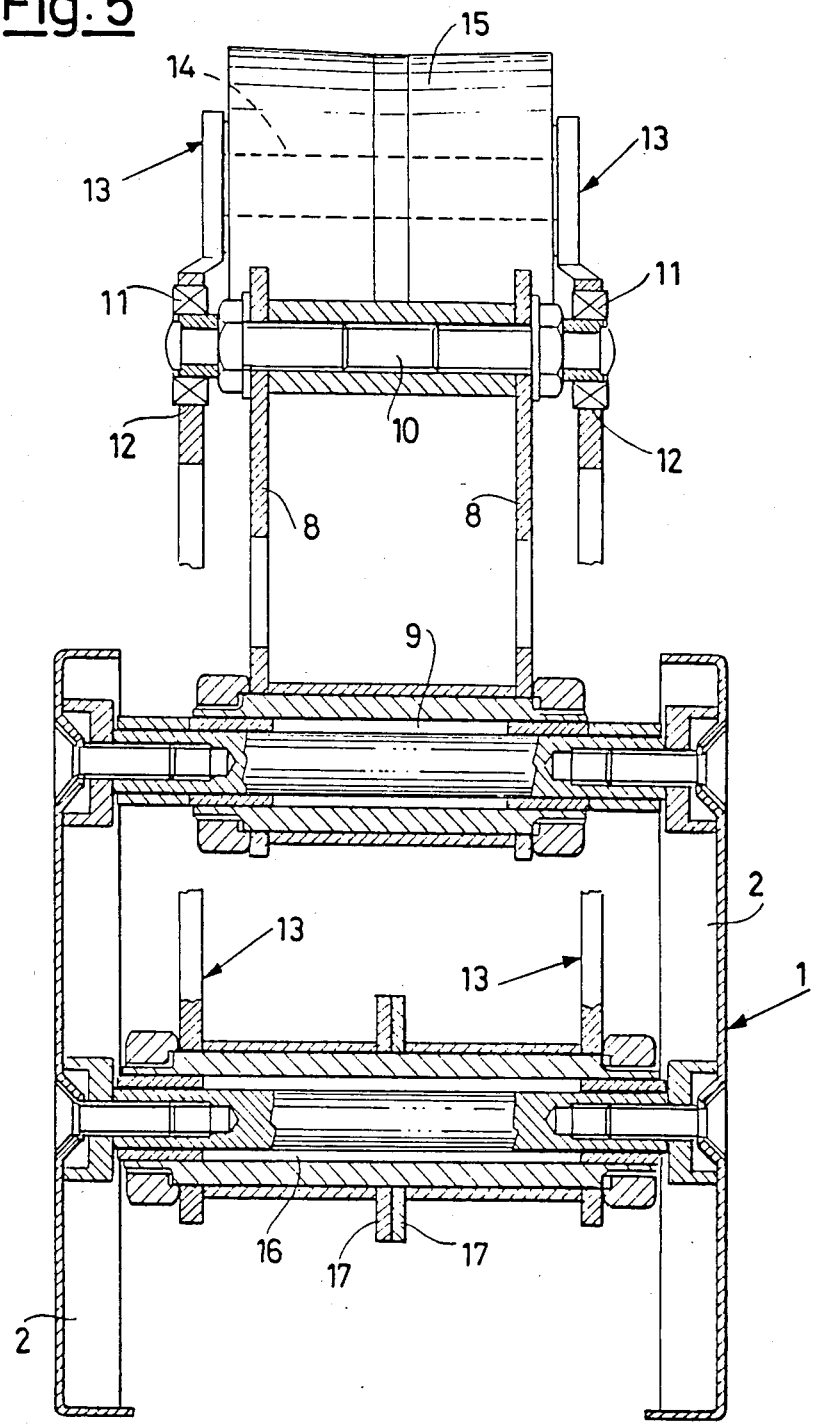
FIG. 5 shows further enlarged details of said taping unit, in section along line V—V of FIG. 1.

With reference to the general views of FIGS. 1 and 2, as well as to the partial sections of FIG. 2 to 5, the taping unit shown in the drawings comprises a casing 1 formed by two parallel walls 2 (connected by cross-members 47), between which the several members and operating mechanism of the unit are housed and supported.

One of such members is a rubber-like applying inlet roller 3, which is rotatably mounted on pivot 4 arranged on a projecting end 5 of a pair of parallel arms 6, connected by cross-members 46 and having shaped windows 21 engaged with the fixed pivot 22. Another end of the arms 6 is hinged at 7 with a cooperating end of a pair of T-shaped levers 8 with fixed fulcrum 9 extending from one to another of the two sidewalls 2 of the casing 1. Another end of the T-shaped lever 8 in its turn is provided with a pin 10 with rollers 11 slidingly inserted in rectilinear windows 12 of a pair of lever arms 13, which carry a support pivot 14 for a rubber-like applying outlet roller 15. The lever arms 13 have a fixed fulcrum 16, on which there are also mounted integrally with the lever arms 13 two adjacent crank arms 17, to which there is attached at 18 a spring 19 adjustably drawn by a screw clamp 20.

Thanks to said spring, the above said mechanism keeps the two inlet and outlet rollers 3 and 15 projecting from the outline of the casing 1, at the same time allowing both rollers to return into the same outline under the thrust of an advancing carton 59, the first roller following a path, firstly inclined with great slope, then inclined with less slope, then almost vertical, which is defined by corresponding lower, intermediate and upper portions 23, 24 and 25 of the shaped windows 21 and the second roller following a curved path with great radius, which is defined by the rotation of the lever arms 13 about the fixed fulcrum 16.

Two brushes 26 and 27 are fixed to the end 5 of the parallel arms 6 and to the T-shaped levers 8 for the purposes which will be described later. For the same purposes there is also provided a brush 28 mounted on a resilient blade 29 extending from a bracket 30 fixed to the casing 1.

Between the two sidewalls 2 of the casing 1 are also supported rotation pivots 31 for a first pair of levers 32, which have vertical windows 42 engaged by the fixed pivot 22 and on which is pivoted at 33 a second pair of levers 34, which carry a plate 35, on which a cutting blade 37 is fixed at 36. As can be seen particularly in FIG. 1, a pair of wire springs 38 with elastic load adjustable by means of a clamp 39 engageable with either one or the other of a plurality of selectable holes 40 extends along the sidewalls 2 of the casing 1 up to engage a horizontal pin 41 (FIG. 4) to urge upwards resiliently the pair of levers 34 and consequently, through the pivot 13, the other pair of levers 32. The choice of the length of the windows 42 and of the position of the pivot 33 in such that said resilient stress normally keeps an actuating portion 43 of the levers 32 and a similar actuating portion 44 of the levers 34 out of the outline of the casing 1; in such a condition, on the contrary, the cutting blade 37 remains within the outline of the pair of levers 32, hidden and protected by two shaped members 45, for example in the form of bars, integral with said levers 32.

To the above described mechanism is associated an adhesive tape supplying system, which has the function of unwinding progressively an adhesive tape 48 from a roll 49 rotatably carried by an arm 50 extending downwards from the casing 1 (FIG. 1). With the roll 49 is engaged by pressure a pick-up and centering roller 51 (provided with sidewalls 71), which is rotatably carried by a lever arm 52 fulcrued at 53 on the casing 1 and subjected to the elastic stress of a spring 54. Once separated from the roll 49, the tape 48 passes around the pick-up and centering roller 51, thereby inverting its direction movement, and then arrives with its free end at the inlet roller 3, progressively passing around guide rollers 55, 56, 57 and 58. The guide roller 55 is provided with sidewalls 72 for tape centering purposes and is rotatably mounted on the pair of levers 32 in such a way as to be movable along a circular path having its center on the axis of the pivot 31, as evidenced in FIGS. 12, 13 and 14. The purpose and the result of this arrangement will be explained later.

The guide roller 56, of the one-way clutch type, is in its turn more advanced than the inlet roller 3 in the direction of advancement of the cartons to be sealed (arrow F in FIG. 11) and both the following guide rollers (57 and 58) are carried by the same lever arms 6 which carry the inlet roller 3 also. As evidenced in FIGS. 11 and 12 and as will be repeated later, this allows the inlet roller 3 to approach progressively the guide roller 56 during its movement of return into the outline of the casing 1 under the thrust of an advancing carton 59, thereby loosening the tape length between the rollers 56 and 3 up to the time of the complete disappearing of the inlet roller 3 (FIG. 12). In this way it is avoided the tensioning of the tape with the inlet roller 3 still engaged with the carton front and are thus avoided dangerous stresses of the carton under the double engagement of the inlet roller 3 urged to protrude outwards and of the tensioned tape 48 urged to resist the unwinding drawing from the roller 49.

The guide roller 56 has also the feature of being supported, through a free-wheel mechanism 65, by a support pivot 60 (FIG. 8), which is eccentrically mounted through trunnions 61 on the sidewalls 2 and at the center of rotatable disks 62, which are also fastened to the same pivot 60 by means of eccentric screws 63 passing through arcuated window 64 of the sidewalls 2 FIG. 7). The guide roller 56 may thus be selectively positioned in the position indicated in solid line in FIG. 6 or in that indicated in dash-dot line in the same Figure or further in several intermediate positions between the two above said. The purpose of this adjustment of position will be made clear later. Of course, similar results may be obtained through a translation, rather than an eccentric rotation of the pivot 60.

Finally the taping unit illustrated in the drawings is provided with a cutting device which allows the cutting and the initial arrangement of the free end of the tape in an exact position in contact with the roller 3.

Figure 9:
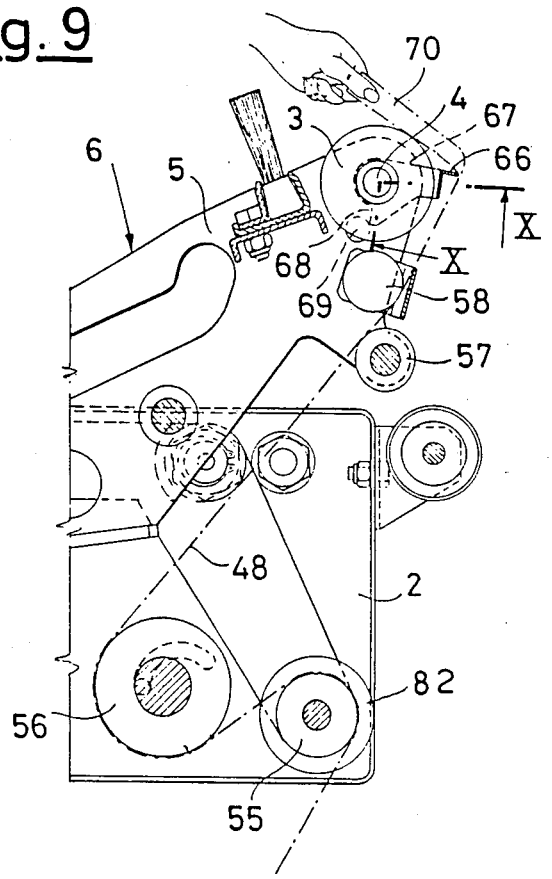
FIG. 9 shows the detail of an initial operation of cutting of the adhesive tape for the arrangement of its free end in suitable position for the execution of the successive sealing operations.
Figure 10:
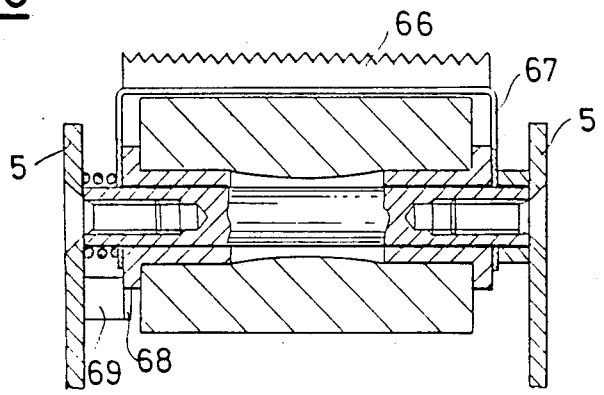
FIG. 10 shows the enlarged detail in section along line X—X of FIG. 9, of the device for carrying out said cutting.

As may be seen in FIGS. 1, 9 and 10, said cutting device comprises a cutting blade 66 supported by an inversed-U frame 67, which is rotatably supported by the same rotation pin 4 of the inlet roller 3. A projection 68 of the frame 67 is able to engage a stationary abutment 69 supported by the end 5 of one of the two lever arms 6 to define the cutting position of the blade 66, shown in FIG. 9. The rest position, on the contrary, is the diametrally opposed one of FIG. 1.

In order to understand the operation of the taping unit illustrated in the drawings, assume that the unit is inserted in a suitable space in the carton advancement plane in a sealing machine of known type. Still with all the several members and mechanism in rest position as in FIG. 1, it is preliminarly carried out the positioning of the adhesive tape 48, by unwinding it from the roll 49, making it passing on the several pick-up and guide rollers 51, 55, 56, 57 and 58 and finally bringing the free end (initially provided with "leader extension" 70, FIG. 9) near the inlet roller 3. The cutting blade 66 is then arranged in the cutting position of FIG. 9, suitably chosen so that its distance from the working plane (corresponding to the top of the sidewalls 2 of the casing 1) is equal to the desired height of the tape length to be applied to the front wall of the cartons, and the cutting of the tape is manually executed. Having successively returned the blade 66 to the rest position of FIG. 1, the cut end of the tape is approached with its non-adhesive face to the inlet roller 3, as shown in FIG. 1. The taping unit is thus ready for the sealing operation.

The cartons to be sealed reach the taping unit by advancing, as known, on a resting plane coplanar with the top of the casing 1. At the inlet of the taping unit the cartons further rest on a support roller 71 supported by the casing (FIG. 11) and then prosecute (FIGS. 12–14) along the top of the sidewalls 2.

The several mechanisms of the taping unit start operation when the front wall 72 of the first carton 59 reaches the inlet roller 3. At that point, the free end of the adhesive tape 48 adheres with its adhesive face to said wall of the carton, using to this end the resistance of the inlet roller to the advancement of the carton.

While the advancement of the cartons prosecutes, a longer and longer length of adhesive tape adheres to the front of the cartons, approaching the lower front corner 73 (FIG. 11), and at the same time the inlet applying roller 3 is thrusted forwards by the advancing carton and caused to run, against the resistance of the spring 19, an initially very inclined withdrawal path defined by the portion 23 of the shaped windows 21 of the support arms 6 and then a less inclined withdrawal path defined by the portion 24 of the same windows 21; in this way, the inlet roller 3 firstly accompanies the initial length of tape along the front wall of the carton and then prosecutes the withdrawal movement, accompanying the advancement movement of the carton. Due to the kinematic connection of the support arms 6 with the T-shaped levers 8 and of the latter with the lever arms 13, the withdrawal movement of the inlet applying roller is accompanied by a simultaneous withdrawal movement of the outlet applying roller 15, carried out through the rotation of the lever arms 13 about the axis of the pivot 16.

Figure 11:
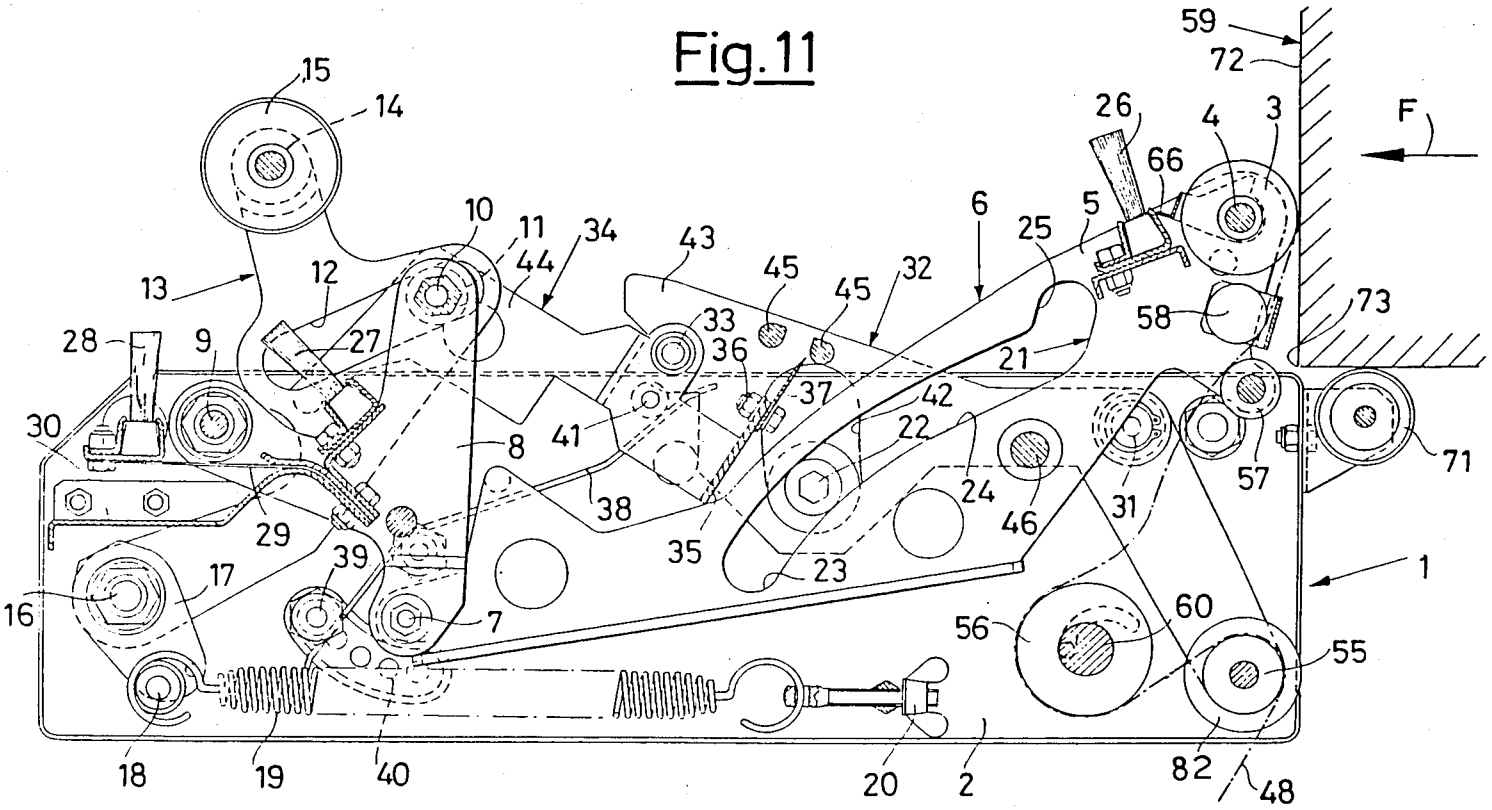
FIGS. 11 to 15 show views in longitudinal section of said taping unit during the passage of a carton to be sealed.
Figure 12:
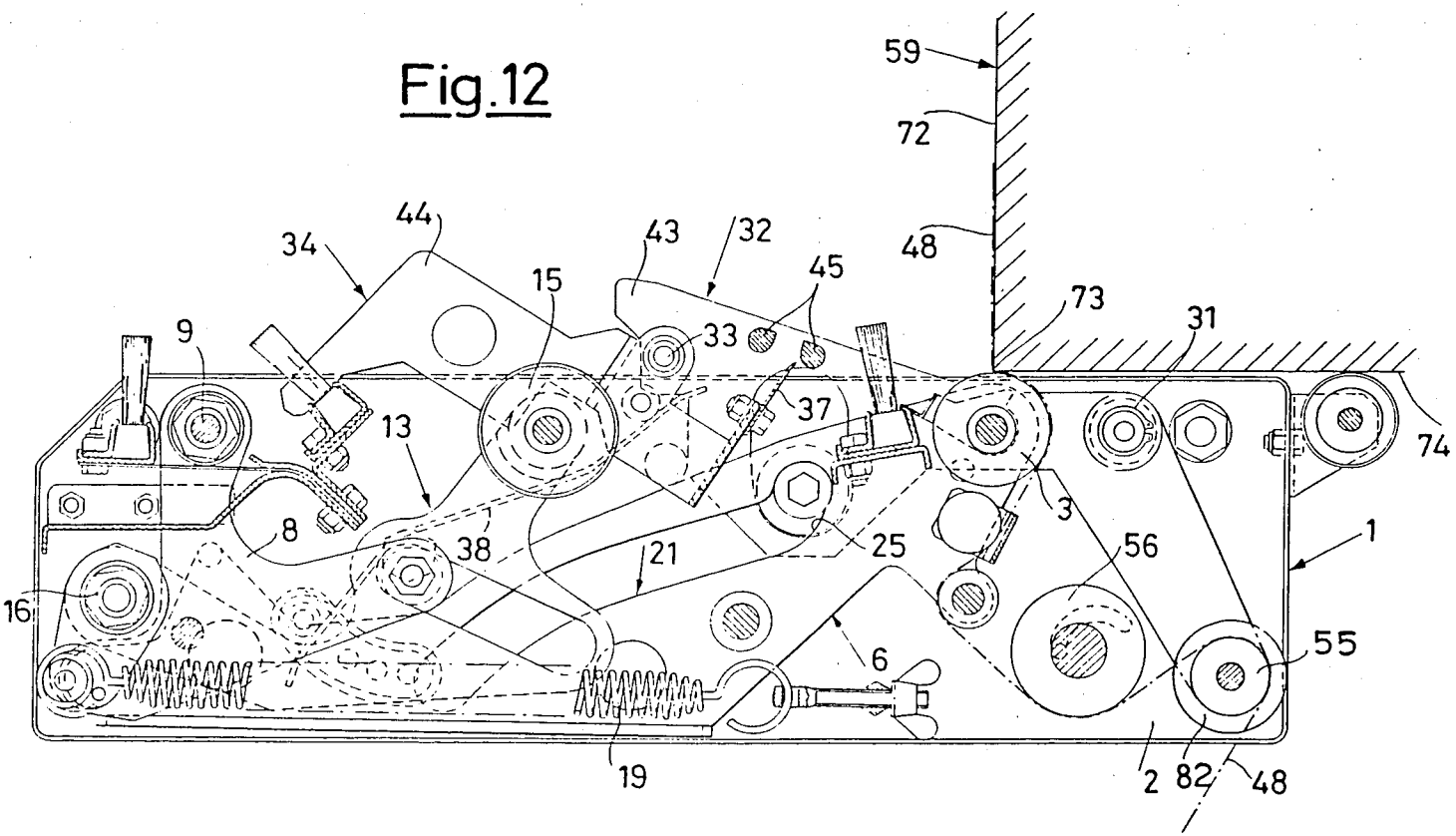

As may be seen in FIG. 11, the withdrawal movement of the inlet roller 3 causes a certain approachment of the same roller to the unidirectional guide roller 56, the result being that the length of adhesive tape interposed between the rollers 3 and 56 takes a loose condition which avoids any necessity for the advancing carton to win the resistance and therefore to suffer the stresses of a tensioned tape. A possible damage for the carton is thus avoided, as well as a possible sliding of the tape along the carton wall.

While the advancement of the carton still prosecutes (FIG. 12), the attachment of an initial length of tape to the front of the carton is completed and the inlet roller 3, still thrusted by the carton front, completes its withdrawal into the outline of the casing 1, accompanied, with circular path, by the outlet roller 13. Since the portion 25 of the shaped windows 21 of the support arms 6 is almost vertical, the last part of the withdrawal movement of the inlet roller is similarly almost vertical, thereby allowing the inlet roller to overcome rapidly the lower front corner 73 of the carton and to put itself under the lower or bottom wall 74 of the carton without creating in that step resistances with horizontal component which could cause "pointings" of the lower front corner 75 against the inlet roller 3 and therefore jamming and/or damages of the carton, especially in case of swelling of the carton bottom. Still in the latter step the carton draws the adhesive tape 48, retrieving the tape excess which caused the loose condition of FIG. 11 and tensioning the same tape.

Figure 13:
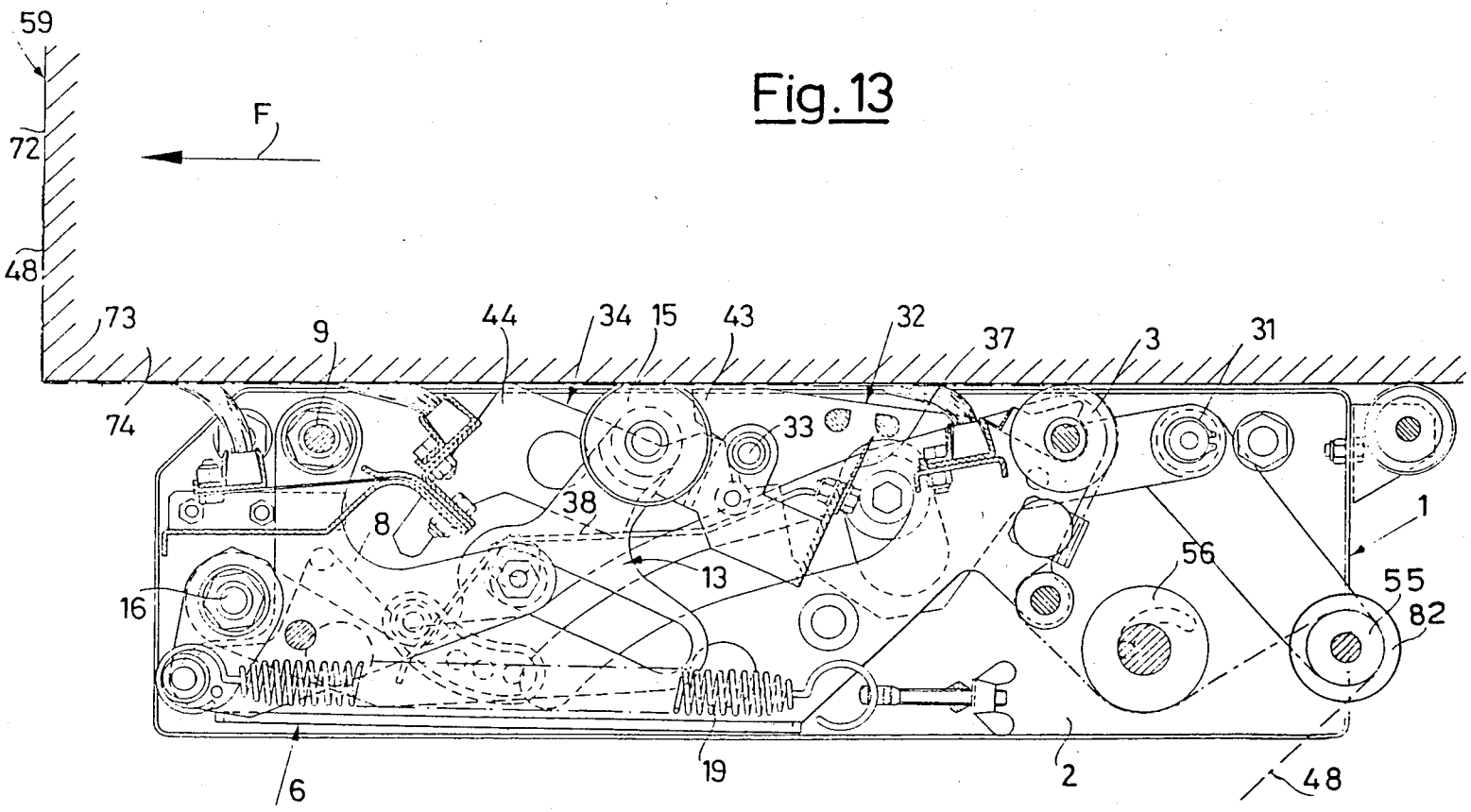

The further advancement of the carton causes the progressive unwinding of the tape from the roll 49 due to the drawing exerted by the same carton. A longer and longer length of tape thus adheres to the lower or bottom wall of the carton (really constituted by four inwardly bent flaps to define a longitudinal center slit along which the sealing tape 48 is applied), suitably pressed by the outlet and inlet rollers 15 and 13, on which it slides freely and is further smoothed by the brushes 28, 27 and 26. The engagement of the carton bottom with the actuating portions 43 and 44 of the two pairs of levers 32 and 34 further causes in this step the complete withdrawal of said pairs of levers into the outline of the casing. This situation is illustrated in FIG. 13 and, due to the increased distance between the roller 55 supported by the pair of levers 32 and the stationary roller 56, results into a suitable tensioning of the tape 48 in the area between the inlet and the outlet rollers 3 and 15.

Figure 14:
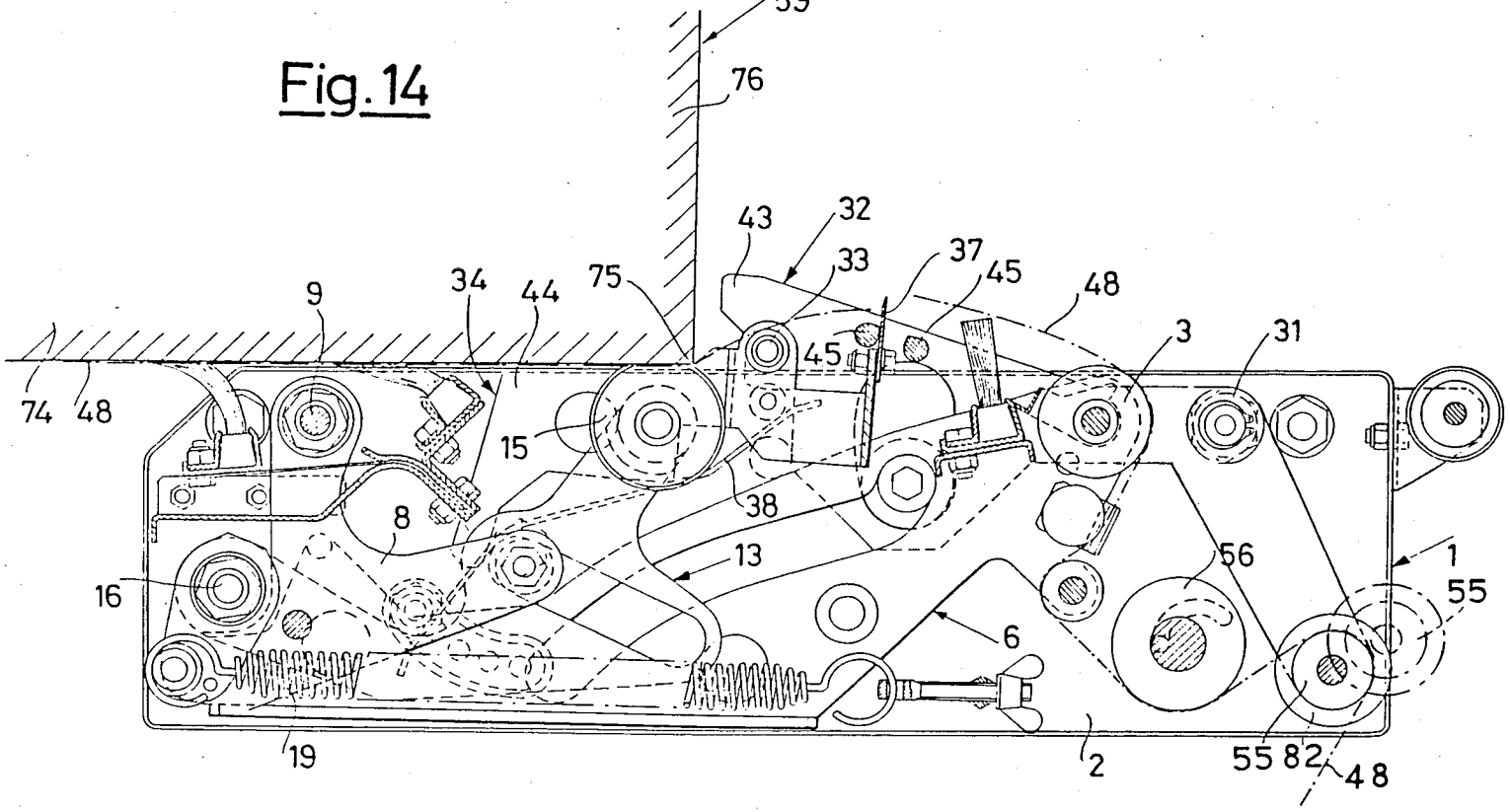

Nothing happens when the carton bottom abondons the inlet roller 3, which is retained in withdrawn condition by the corresponding withdrawn condition of the outlet roller 15, still under the carton bottom (FIG. 14). When the lower rear corner 75 lets free the actuating portion 43 of the pairs of levers 32, on the contrary, the spring 38 suddenly urges the pair of levers 32 to come out of the outline of the casing 1 and, conveying the pivot 33 while the actuating portion 44 is kept stationary by the carton bottom, to cause the further rotation of the pair of levers 34 about the pivot 33. The result is that the cutting blade 37 carries out a sudden composed movement of rotation about the two pivots 31 and 33, that is with two lever arms which add to one another and produce double speed, and passing through the protecting bars 45 comes out of the outline of the casing 1 and of that of the pair of levers 32 to reach and cut the adhesive tape 48 between the two inlet and outlet rollers 3 and 15, thereby defining a final length of tape of prefixed length, equal to the distance between the actuating portion 43 and cutting blade 37. Between the cutting point and the unidirectional guide roller 56, on the other hand, it is defined a tape length which a suitable choice of the position of the blade 37 makes equal to that of the initial length of tape defined between the guide roller 56 and the inlet roller in the rest position of FIG. 1 and after cutting and initial arrangement as in FIG. 9. The cutting operation is illustrated in FIG. 14 and due to the return of the roller 55, together with the pair of levers 32, from the position of FIG. 13 to that of FIG. 14, causes the loosening of the tension of the tape, the cut ends of which are allowed to position again in the most suitable way for the subsequent sealing operation.

Figure 15:
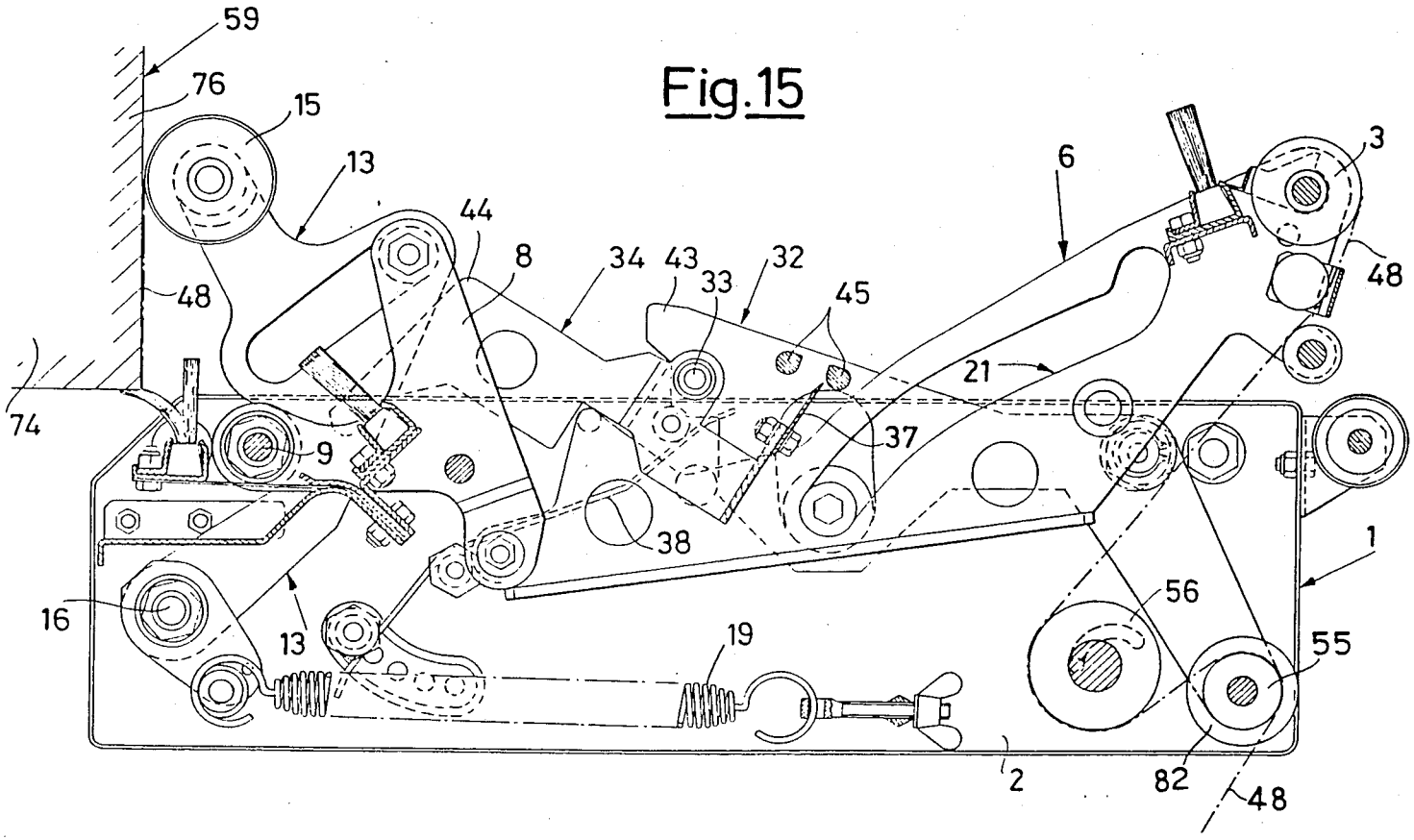

As may be understood from FIG. 15, when the carton bottom lets free the outlet roller 15, the latter allowed to come out of the casing outline together with the inlet roller 3, and immediately after, when the carton bottom lets free the actuating portion 44 of the pair of levers 32 also, the return of the cutting blade 37 into the normal rest position, protected by the bars 45, is allowed. During its movement of coming out, the outlet roller 15 accompanies the final length of adhesive tape along the rear wall 76 of the carton, causing it to adhere corretly to the wall; to such end, the position of the fulcrum 16 and the shape of the lever arms 13 are chosen in such a way as to give the roller 15 a movement with strong horizontal component, adapted to ensure the application of the tape to the rear wall of the carton (FIG. 15), following the final advancement of the same carton. In its turn, the inlet roller 3, coming back into rest position (FIG. 15) and therefore moving away from the unidirectional roller 56, allows the initial length of the cut tape to slide on the surface of the same tape, allowing the free end of the tape to position exactly in the correct initial position of FIG. 1. The taping unit is thus ready for a new sealing operation.

While the position of the free end of the tape illustrated in FIG. 1 is correct, it may happen that tapes of different physical features, particularly of different elasticity, have a trend to allow different length of tape to unwind from the roller 49 and over all from the unidirectional roller 56, during the conveying operation carried out by the carton, which different length finally results, at the end of the operation and with no more tensioned tape, into a different, non-correct positioning of the free end on the tape of the inlet roller 3. In order to obviate this drawback, according to the type of employed tape, one acts on the adjustment system of the roller 56, more precisely on the screws 63, so as to change its position with respect to the eccentric pivots 61. In such a way, as illustrated in FIG. 6, the tape length which is, at rest, between the rollers 56 and 3 is changed so as to take into account the successive tensioning and lengthening of the tape in the step of FIG. 13.

I claim:

1. Automatic taping unit for carton sealing machines, comprising a casing adapted to be fixed to a sealing machine along the carton advancement path, an inlet applying roller and an outlet applying roller elastically urged to project from said casing to be engaged and forced to withdraw into said casing by the front of an advancing carton, an adhesive tape supply arranged to put, at rest, a free end of the tape in contact with said inlet roller in order to be engaged and adhesively drawn forward by the carton front and further realized in such a way as to allow subsequently said tape to follow the drawing of said free end and to slide on said inlet roller to extend adhesively along the adjacent horizontal wall of the carton, and a cutting blade arranged between said inlet and outlet rollers and provided with actuating means capable of causing it to return into the outline of said casing before being reached by the carton front and to project from said outline for cutting the tape between said inlet and outlet rollers after having been overcome by the rear wall of the carton and before said horizontal wall of the carton abandons said outlet roller, wherein said adhesive tape supply includes at least one tape guide member, which is arranged upstream of said inlet applying roller in such a position as to be progressively approached by said inlet applying roller during its withdrawal movement, wherein said tape guide member is a guide roller, wherein said guide roller is rotatably mounted on a support pivot, which is in its turn provided with an eccentric pivot, there being provided means for changing the angular position of said support pivot and of said guide roller with respect to said eccentric pivot.

2. Taping unit according to claim 1, wherein said means for changing the angular position comprise locking screws for said support pivot which are inserted in arcuate windows of said casing.

3. Taping unit according to claim 1, wherein said guide roller is of unidirectional type.

* * * * *